US007074055B2

(12) United States Patent
Yang et al.

(10) Patent No.: US 7,074,055 B2
(45) Date of Patent: Jul. 11, 2006

(54) ELECTRICAL CONTACT

(75) Inventors: Zhen-Qi Yang, Kunsan (CN); Fu-Jin Peng, Kunsan (CN); Nan-Hong (Nick) Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/115,544

(22) Filed: Apr. 26, 2005

(65) Prior Publication Data

US 2006/0019509 A1 Jan. 26, 2006

(30) Foreign Application Priority Data

Jul. 23, 2004 (TW) ..... 93211673 U

(51) Int. Cl.
*H01R 9/09* (2006.01)

(52) U.S. Cl. ..... 439/83; 439/342; 439/876

(58) Field of Classification Search ..... 439/83, 439/342, 259, 261, 262–266, 330, 331, 876
See application file for complete search history.

(56) References Cited

U.S. PATENT DOCUMENTS

| | | | | |
|---|---|---|---|---|
| 6,533,591 | B1 * | 3/2003 | Lee | 439/83 |
| 6,554,634 | B1 * | 4/2003 | Lin et al. | 439/342 |
| 6,565,368 | B1 * | 5/2003 | Liao et al. | 439/83 |
| 6,908,328 | B1 * | 6/2005 | Lei et al. | 439/342 |
| 6,929,488 | B1 * | 8/2005 | Kung et al. | 439/83 |
| 2002/0151204 | A1 * | 10/2002 | Kukita et al. | 439/342 |
| 2002/0155743 | A1 * | 10/2002 | Kukita et al. | 439/342 |

* cited by examiner

*Primary Examiner*—Hien Vu
(74) *Attorney, Agent, or Firm*—Wei Te Chung

(57) ABSTRACT

An electrical contact (1) of an electrical connector includes a board-like base (11), a first arm (14) extending from a side of the base, and a second arm (15) extending from an opposite side of the base. The first arm extends forwardly and circuitously in a first plane, while the second arm extends forwardly and circuitously in a second plane. The second plane is parallel to and lower than the first plane.

5 Claims, 6 Drawing Sheets

ELECTRICAL CONTACT

BACKGROUND OF THE INVENTION

1. Field of the Invention

The present invention relates to an electrical contact, and especially to an electrical contact used in an electrical connector for electrically connecting an integrated circuit (IC) to a printed circuit board (PCB).

2. Description of the Prior Art

FIG. 5 illustrates a conventional electrical contact 2 to be received in an IC socket (not shown). The electrical contact 2 is formed from a metal sheet as shown in FIG. 6. The electrical contact 2 includes a board-like base 20, a winding first arm 21 extending from a side of the base 20, a winding second arm 22 symmetrically extending from an opposite side of the base 20, and a solder, portion 23 perpendicularly bent from a lower end of the base 20. The first arm 21 includes a first transverse connecting portion 211 connecting the base 20, a first vertical connecting portion 212 extending from the first transverse connecting portion 211, and a first contacting portion 213 formed at a free end of the first vertical connecting portion 212. The second arm 22 is symmetrical to the first arm 21 with respect to a central line of the base 20 and correspondingly includes a second transverse connecting portion 221, a second vertical connecting portion 222 and a second contacting portion 223. The first contacting portion 213 and the second contacting portion 223 are disposed face to face in a close position. When an IC (not shown) is loaded on the IC socket, a pin (not shown) of the IC extends between the first contacting portion 213 and the second contacting portion 223, so that desired circuit is formed.

The first arm 21 and the second arm 22 symmetrically extend transversely from the base 20, which makes the distance between any two adjacent electrical contacts along the metal strip (shown in FIG. 6) increase, and which occupies a large space and increases the material cost.

Hence an improved electrical contact is desired to overcome the disadvantage of the related prior art.

BRIEF SUMMARY OF THE INVENTION

An object of the present invention is to provide an electrical contact in an unsymmetrical structure, so that the distance between two adjacent contacts along a metal strip decreases.

An electrical contact of an electrical connector in accordance with the present invention comprises a board-like base, a first arm extending from a side of the base, and a second arm extending from an opposite side of the base. The first arm winds forwardly and ends with a first contacting portion having a bottom face, while the second arm winds forwardly and ends with a second contacting portion having a top face, wherein when said electrical contact is unwrapped, said bottom face of the first contacting portion is no lower than said top face of the second contacting portion in a vertical direction.

Other objects, advantages and novel features of the present invention will become more apparent from the following detailed description of the present embodiment when taken in conjunction with the accompanying drawings.

DETAILED DESCRIPTION OF THE INVENTION

Figure 1:
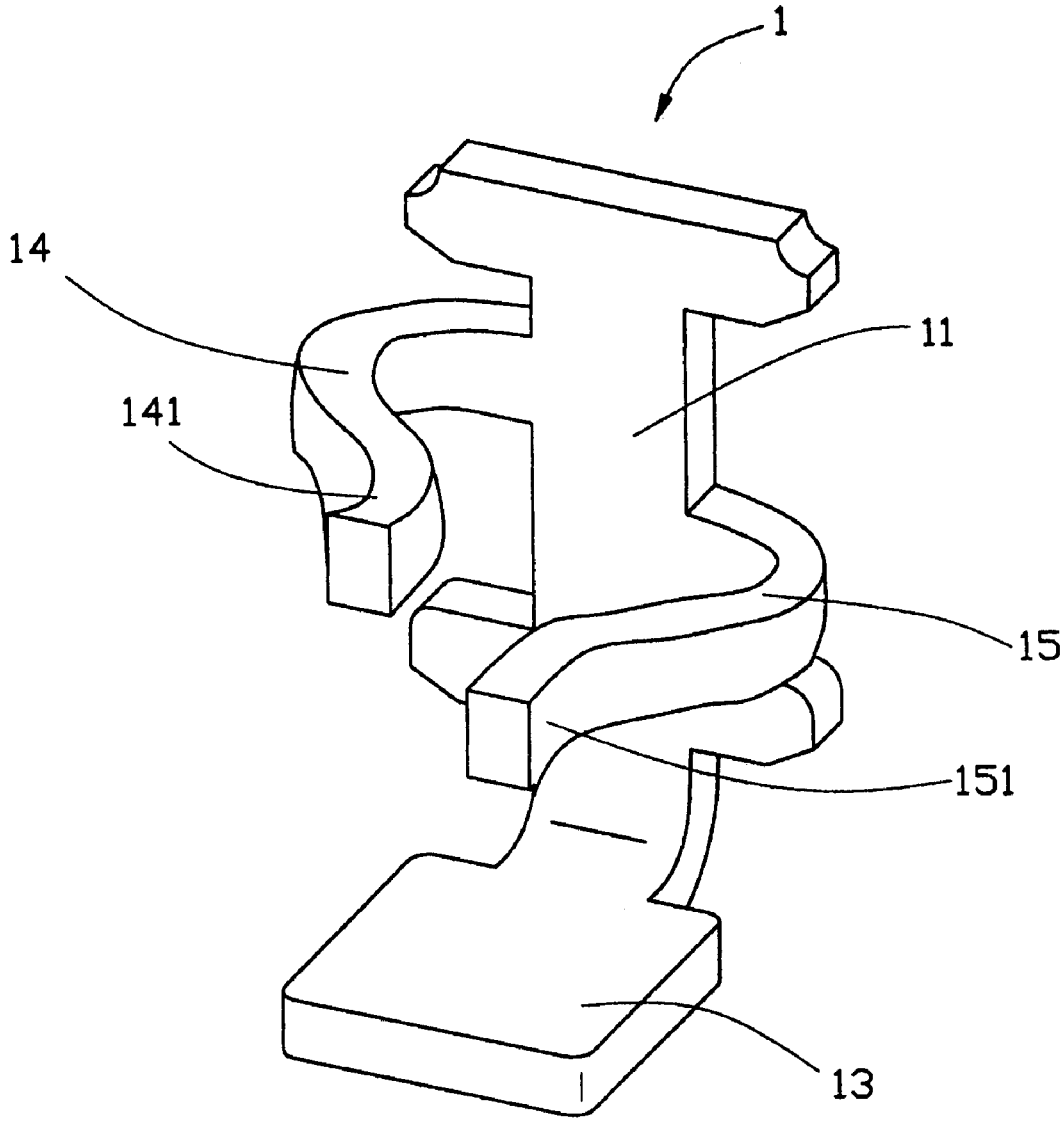
FIG. 1 is a perspective view of an electrical contact according to the present invention.
Figure 2:
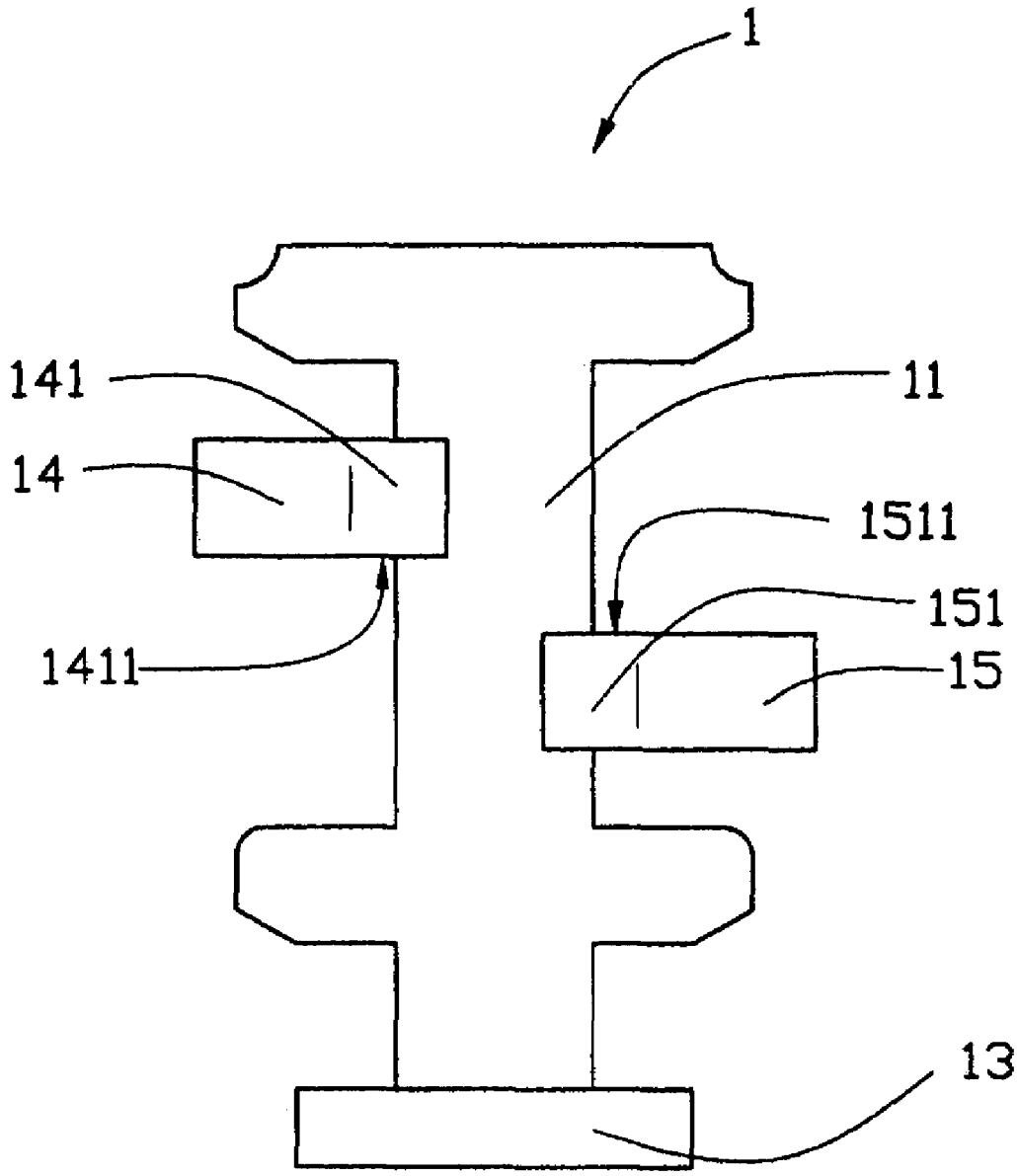
FIG. 2 is a front view of the electrical contact.
Figure 3:
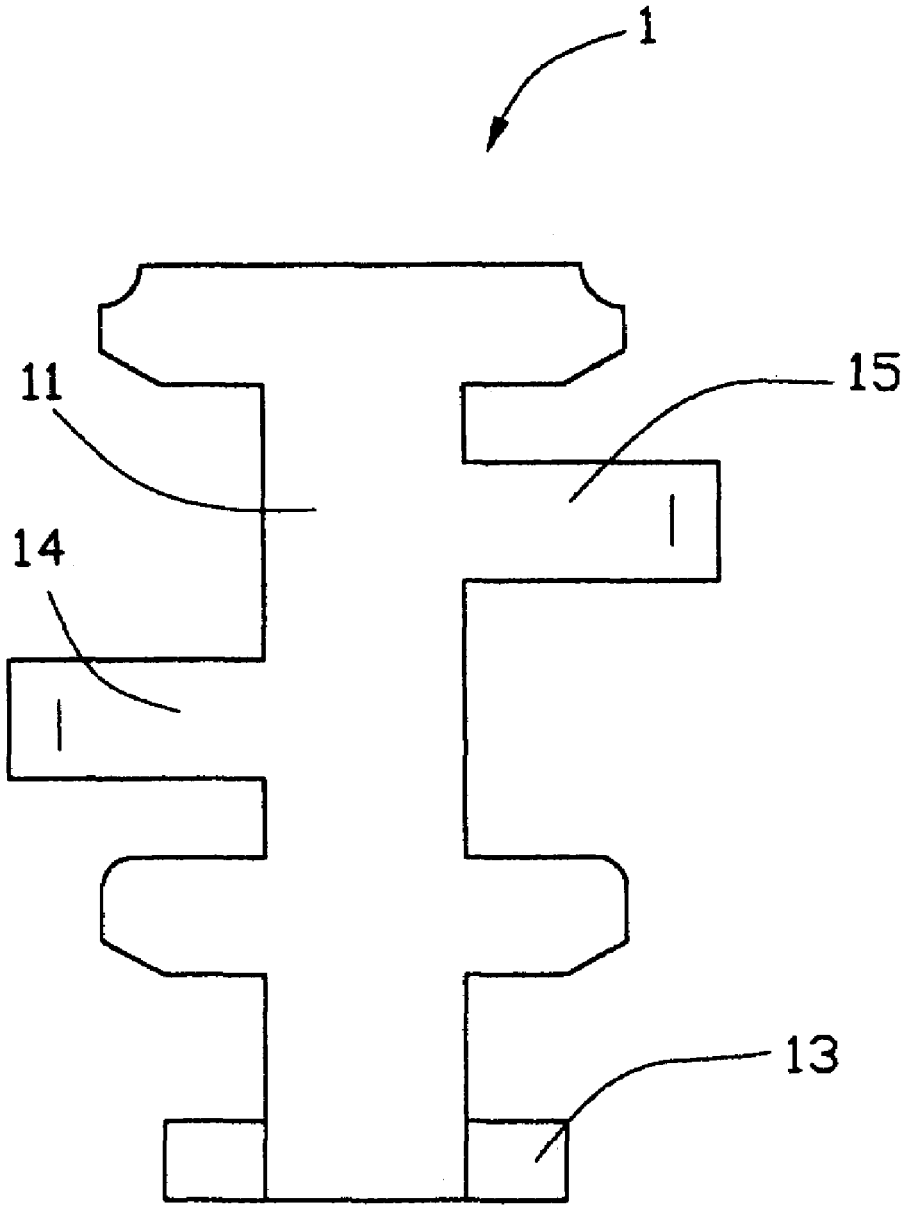
FIG. 3 is a back view of the electrical contact.

FIGS. 1, 2 and 3 are views of an electrical contact 1 according to the present invention. The contact 1 includes a board-like base 11, a first arm 14 extending from a side of the base 11, a second arm 15 extending from an opposite side of the base 11, and a solder portion 13 perpendicularly connecting to a lower end of the base 11. The first arm 14 extends forwardly and circuitously in a first horizontal plane perpendicular to the base 11 and then ends with a first contacting portion 141. The first contacting portion 141 extends perpendicularly to the base 11 and defines a bottom face 1411. While, the second arm 15 is symmetrical to the first arm 14 except that the second arm 15 is located in a second horizontal plane below the first horizontal plane. The second arm 15 has a second contacting portion 151 and the second contacting portion 151 further defines a top face 1511. The first contacting portion 141 and the second contacting portion 151 are used to contact a pin of an IC (not shown) when the IC is loaded on a socket (not shown) in which the electrical contact 1 is assembled. The solder portion 13 is used for being soldered to a PCB.

Figure 4:
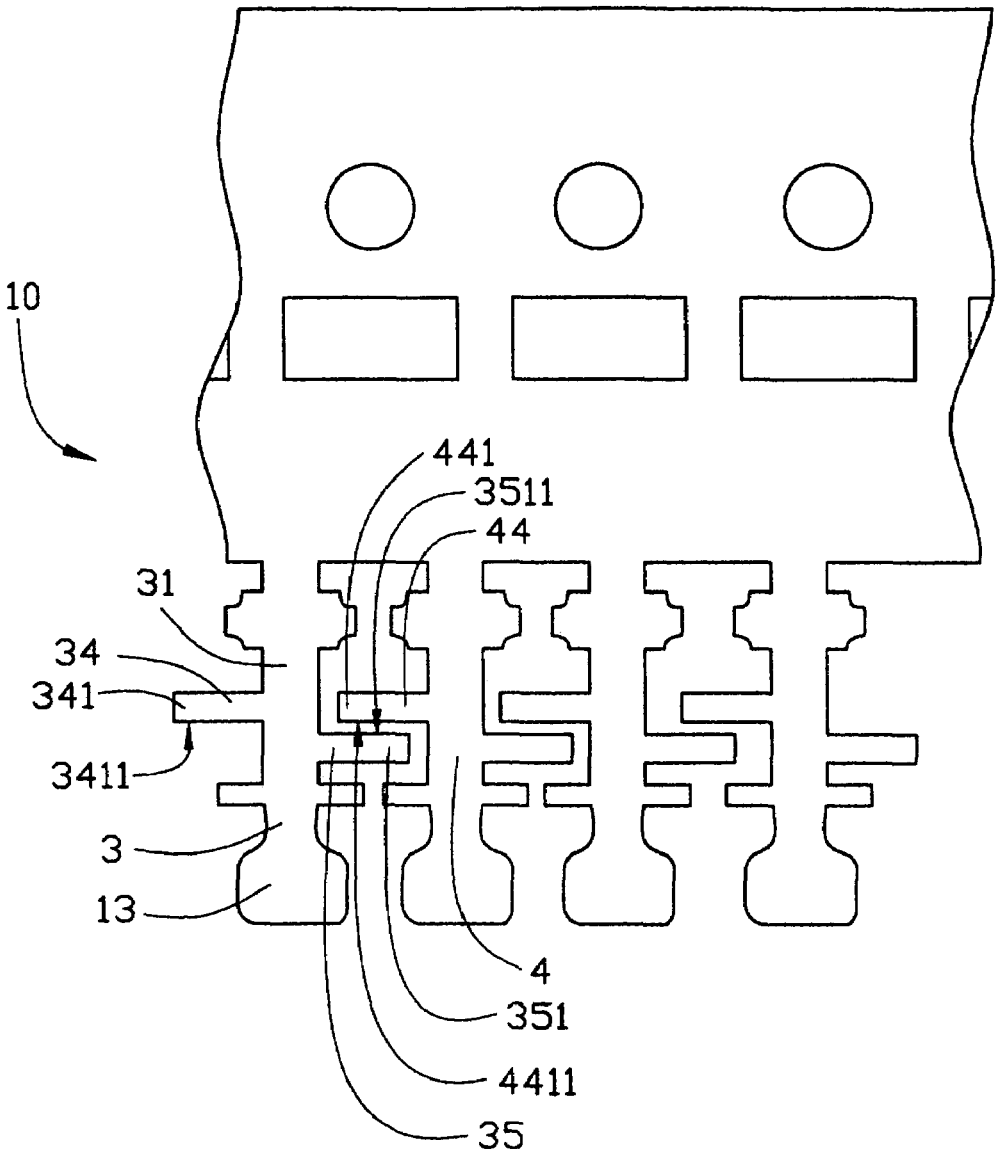
FIG. 4 is a layout of a plurality of semi-finished contacts before being formed into the electrical contacts, the semi-finished contacts connecting to a carrier strip.
Figure 5:
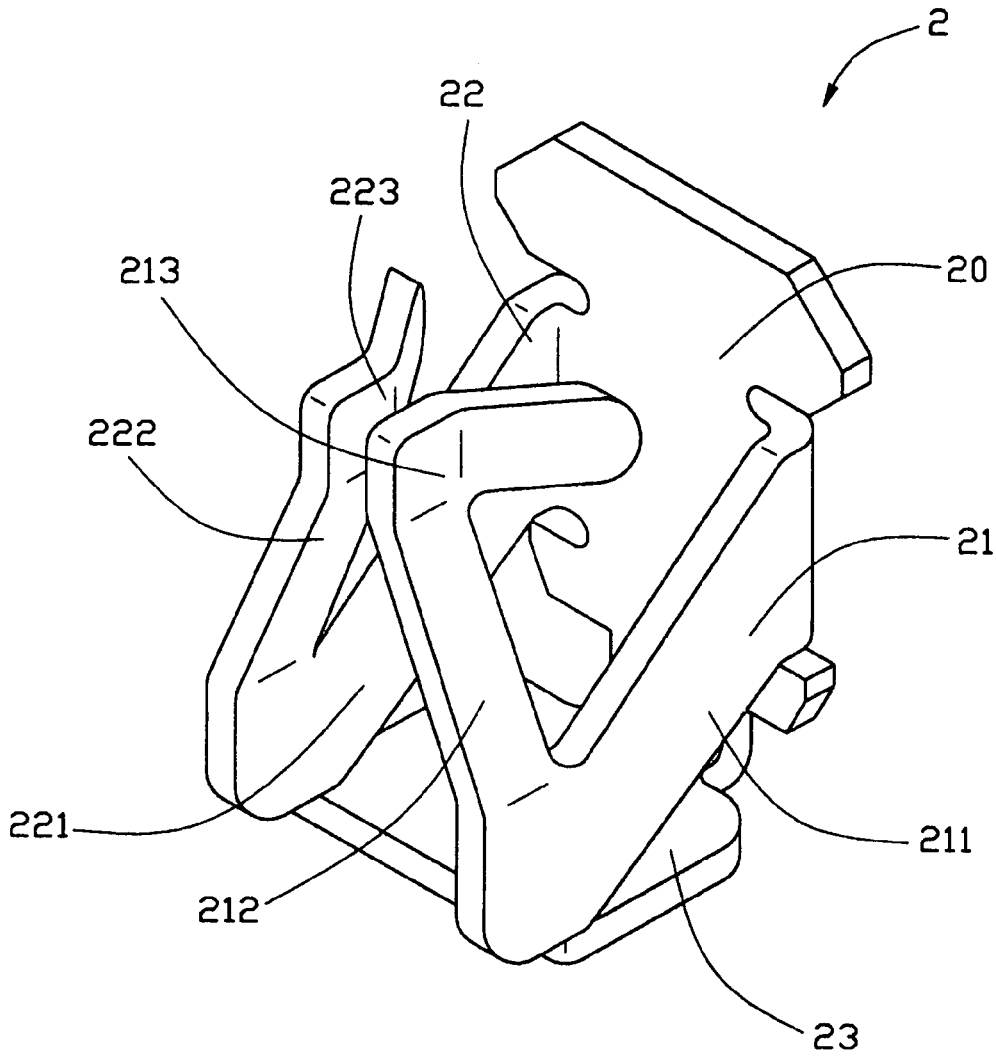
FIG. 5 (PRIOR ART)
FIG. 5 is a perspective view of a conventional electrical contact.
Figure 6:
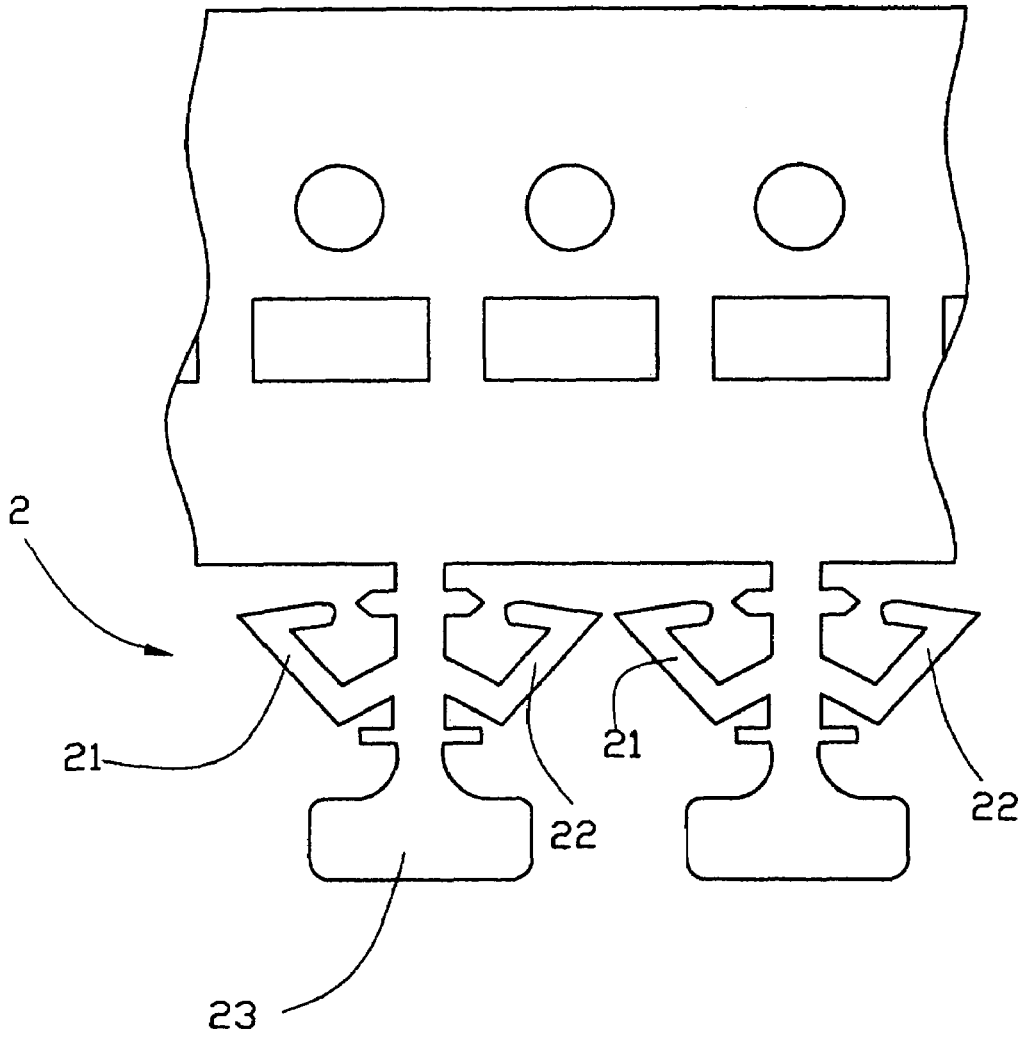
FIG. 6 (PRIOR ART)
FIG. 6 is a layout of another plurality of semi-finished contacts before being formed into the conventional electrical contacts, the semi-finished contacts connecting to a carrier strip.

Referring to FIG. 4, a metal strip 10 with a plurality of semi-finished contacts is shown. The semi-finished contacts 3, 4 are used for being further formed into the electrical contacts 1. The semi-finished contact 3 includes a base 31 with an upper end connecting to a carrier strip (not labeled), a first arm 34 straightly extending from a side of the base 31, a second arm 35 straightly extending from an opposite side of the base 31, and a solder portion 13 extending downwardly from a lower end of the base 31. The first arm 34 ends with a first free end 341 defining a bottom face 3411, and the second arm 35 ends with a second free end 351 defining a top face 3511. The first arm 34 is higher than the second arm 35 and the bottom face 3411 of the first free end 341 is higher than the top face 3511 of the second free end 351.

The semi-finished contact 4 has the same configuration as the semi-finished contact 3 and is disposed by the right side of the semi-finished contact 3. The semi-finished contact 4 comprises corresponding first arm 44 and the first arm 44 ends with a first end 441 defining a bottom face 4411. The bottom face 4411 of the first free end 441 of the semi-finished contact 4 is located above the top face 3511 of the second free end 351 of the adjacent semi-finished contact 3. The first free end 441 of the semi-finished contact 4 is disposed staggeringly with respect to the second free end 351 of the semi-finished contact 3.

When the semi-finished contact 3 is formed into the electrical contact 1, the first arm 34 and the second arm 35 are bent forwardly and circuitously. The first free end 341 and the second free end 351 are bent perpendicularly to the base 31 so that the first contacting portion 141 and the second contacting portion 151 are formed. The solder portion 33 is bent perpendicularly to the base 31 for later soldering the contact 1 to the PCB. When the semi-finished contact 3 is finally cut from the carrier strip 10, an electrical contact 1 is formed.

It is to be understood, however, further though numerous, characteristics and advantages of the present invention have been set fourth in the foregoing description, together with details of the structure and function of the invention, the disclosed is illustrative only, and changes may be made in detail, especially in matters of shape, size, and arrangement of parts within the principles of the invention to the full extent identify by the broad general meaning of the terms in which the appended claims are expressed.

What is claimed is:

1. A metal strip for making a plurality of electrical contacts comprising:

a carrier strip; and a plurality of semi-finished contacts connecting to the carrier strip, each of the semi-finished contacts comprising:

a base portion extending along a vertical direction perpendicular to said carier strip;

a first arm extending outwardly from an outside of the base and perpendicular to said base portion, said first arm forming a substantially U-shaped portion and having a first free end; and a second arm extending outwardly from an opposite outside of the base and perpendicular to said base portion, said second arm forming a substantially u-shaped portion and having a second free end;

wherein the first free end of one semi-finished contact is disposed staggeringly along said vertical direction with respect to the second free end of an adjacent semi-finished contact;

wherein said first arm positions above said second arm.

2. The metal strip according to claim 1, wherein said first arms and said second arms are formed parallel to each other.

3. The metal strip according to claim 1, wherein each of the semi-finished contacts further comprises a solder portion extending from a lower end of the base.

4. An electrical contact of an electrical connector comprising:

a board-like vertical base defining opposite first and second vertical outer side edges and a plane;

a first arm extending laterally and perpendicular relative to said plane from a first point of the first outer side edge of the base;

a second arm extending laterally and perpendicular relative to said plane from a second point of the second outer side edge of the base;

wherein the first point is higher than the second point in a vertical direction;

wherein said first arm essentially extends along a first horizontal plane and being substantially U-shaped, and said second arm essentially extends along the second horizontal plane and being substantially U-shaped, said first plane being higher than the second horizontal plane in said vertical direction.

5. The electrical contact as claimed in claim 4, wherein said first arm and said second arm are of an mirror image arrangement but with an offset along said base in the vertical direction.

* * * * *